US011750990B2

(12) United States Patent
Kukla et al.

(10) Patent No.: US 11,750,990 B2
(45) Date of Patent: Sep. 5, 2023

(54) METHOD FOR AUTOMATICALLY SETTING A SIGNAL PROCESSING PARAMETER OF A HEARING DEVICE

(71) Applicant: Sivantos Pte. Ltd., Singapore (SG)

(72) Inventors: Christoph Kukla, Trabitz (DE); Sven Schoen, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 229 days.

(21) Appl. No.: 17/172,296

(22) Filed: Feb. 10, 2021

(65) Prior Publication Data

US 2021/0250711 A1 Aug. 12, 2021

(30) Foreign Application Priority Data

Feb. 10, 2020 (DE) ..... 102020201608.9

(51) Int. Cl.
*H04R 25/00* (2006.01)

(52) U.S. Cl.
CPC ..... *H04R 25/70* (2013.01); *H04R 25/505* (2013.01); *H04R 25/554* (2013.01)

(58) Field of Classification Search
CPC ..... H04R 25/70; H04R 25/505
USPC ..... 381/60
See application file for complete search history.

(56) References Cited

U.S. PATENT DOCUMENTS

| | | | | |
|---|---|---|---|---|
| 11,070,926 | B2 * | 7/2021 | Umicevic | H04R 25/55 |
| 11,218,813 | B2 | 1/2022 | Baek et al. | |
| 11,376,442 | B2 | 7/2022 | Miller et al. | |
| 2012/0183164 | A1 | 7/2012 | Foo et al. | |
| 2014/0211973 | A1 | 7/2014 | Wang et al. | |
| 2015/0326983 | A1 | 11/2015 | Johnson et al. | |
| 2016/0212552 | A1 | 7/2016 | Schneider et al. | |

FOREIGN PATENT DOCUMENTS

| | | | |
|---|---|---|---|
| CN | 102833662 | A | 12/2012 |
| CN | 103328041 | A | 9/2013 |
| CN | 104715593 | A | 6/2015 |
| CN | 108235753 | A | 6/2018 |
| DE | 102014207311 | A1 | 3/2015 |
| EP | 3280157 | A1 | 2/2018 |

* cited by examiner

*Primary Examiner* — Phylesha Dabney
(74) *Attorney, Agent, or Firm* — Laurence A. Greenberg; Werner H. Stemer; Ralph E. Locher

(57) ABSTRACT

A method for automatically setting at least one signal processing parameter of a hearing device. The immediate surroundings of the hearing device are examined for the presence of at least one node of a wireless communication network. Characteristic information of a detected node is ascertained for a node that has been found to be present and the characteristic information for the detected node is compared with a first dataset of first characteristic information that was respectively stored beforehand for nodes that are marked as known. The comparison results are used to characterize the node that has been detected as present as a known node or as an unknown node on the basis of the characteristic information. The ascertained characteristic information of the detected node is used as a basis for setting the at least one parameter for the signal processing of the hearing device.

18 Claims, 2 Drawing Sheets

METHOD FOR AUTOMATICALLY SETTING A SIGNAL PROCESSING PARAMETER OF A HEARING DEVICE

CROSS-REFERENCE TO RELATED APPLICATION

This application claims the priority, under 35 U.S.C. § 119, of German patent application DE 10 2020 201 608.9, filed Feb. 10, 2020; the prior application is herewith incorporated by reference in its entirety.

BACKGROUND OF THE INVENTION

Field of the Invention

The invention relates to a method for automatically setting a parameter for signal processing of a hearing device.

The term "hearing device" is normally understood to mean devices that are used for outputting audio signals to the ear or more generally to the auditory center of a user of the applicable device (also referred to as the "hearing device wearer"). In particular, this term covers hearing aids. Hearing aids are used by people with a hearing impairment to at least partially compensate for a hearing loss that results from this hearing impairment. To this end, hearing aids normally have at least one electroacoustic input transducer, usually in the form of a microphone, for detecting audible (ambient) sound and converting it into an electrical input signal. In addition, such hearing aids regularly have a signal processing unit configured to analyze the input signal(s) for noise components (e.g. noise, ambient noise and the like), to filter and/or attenuate these noise components and to boost the remaining signal components as useful signal (such as in particular voice and/or music).

To output the input signal processed in this manner to the ear, hearing aids usually comprise an electroacoustic output transducer, e.g., in the form of a loudspeaker or speaker (also referred to as a "receiver"), by way of which the processed input signal is converted into an output sound signal and is output to the ear of the hearing device wearer. Alternatively, hearing aids have a cochlear or bone conduction receiver for outputting an output signal in electrical or mechanical form to the ear.

However, the term "hearing device" also covers so-called tinnitus maskers, which frequently output user-specific noise to the auditory center, or other devices for audio output, such as e.g. headsets ("headphones"), wireless head-phones with and without active noise cancelation, what are known as "hearables" and the like.

Signal processing units of hearing aids usually store device-specific, comparatively complex algorithms for the signal processing of the input signals. In order to be able to individually adapt the respective hearing aid for a hearing device wearer, these algorithms are based on variable parameters, the limits of which are predefined in wearer-specific fashion when the hearing aid is adapted for the hearing impairment of the hearing device wearer.

So as also to be easily able to adapt the output characteristics (tone characteristics) of the hearing device and in particular the intelligibility of voice or other "wanted" useful signals for different sound situations, individual "hearing situations" as standardized representatives of sound situations having the same acoustic features are respectively defined as a so called "hearing situation". An analysis of the input signal in reference to said features can then be used as a basis for detecting a relevant hearing situation (for example "conversation between the hearing device wearer and a second person in peace", "conversation in ambient noise", "surrounded by nature", "surrounded by a public space").

Specific parameter sets (so-called "hearing programs") are usually stored for these hearing situations in a memory unit when the hearing aid is adapted for the respective hearing device wearer. The parameter sets are used to set current parameters of the signal processing depending on the ascertained hearing situation—i.e. the respective hearing program corresponding to the hearing situation is "loaded." These parameter sets match the respective hearing situation and the hearing impairment of the hearing device wearer, as a result of which e.g. voice or other useful signals wanted in the respective hearing situation are output to the ear as intelligibly as possible, or particularly good spatial hearing sensitivity is maintained in road traffic.

However, the continual detection and analysis of the acoustic surroundings for a possible change in the hearing situation consumes battery power, which is why options for alternative and/or simpler detection of hearing situations are desirable.

BRIEF SUMMARY OF THE INVENTION

It is accordingly an object of the invention to provide a method for automatically setting a signal processing parameter in a hearing device which overcomes the above-mentioned disadvantages of the heretofore-known devices and methods of this general type and which provides for a method by means of which parameters of the signal processing of a hearing device can be automatically set without requiring the ongoing or frequent acoustic analysis of the surroundings.

With the above and other objects in view there is provided, in accordance with the invention, a method of automatically setting at least one parameter for signal processing in a hearing device, the method comprising:

examining immediate surroundings of the hearing device for a presence of at least one node of a wireless communication network, wherein a node that is detected as being present is a detected node;

ascertaining characteristic information of the detected node;

comparing the characteristic information of the detected node with a first dataset of first characteristic information respectively stored beforehand for nodes that are marked as known, and concluding from the comparison whether the detected node is a known node or an unknown node; and using the characteristic information of the detected node as a basis for setting the at least one parameter for the signal processing of the hearing device.

In other words, the objects of the invention are achieved by a method for automatically setting at least one signal processing parameter of a hearing device, wherein the immediate surroundings of the hearing device are examined for the presence of at least one node of a wireless communication network, wherein characteristic information of the detected node is ascertained for a node detected as present, and wherein the ascertained characteristic information of the detected node is used as a basis for setting the at least one parameter of the signal processing of the hearing device. In this case there is provision for the characteristic information for the node detected as present to be compared with a first dataset of first characteristic information that was respectively stored beforehand for nodes marked as known, and for the comparison to result in the node detected as present being detected as a known node or as an unknown node on the basis of the characteristic information. Refinements that are advantageous and, in some cases, inventive in themselves are the subject of the subclaims and of the description that follows.

A node of a wireless communication network includes in particular an electronic device that is directly configured to be integrated in a communication network that is implemented for example via a router or the like, e.g. even in the slave mode, and/or to connect to one or more other electronic devices, e.g. via Bluetooth, WLAN or comparable protocols. Directly configured for said integration or connection is intended to mean in particular that the relevant electronic device is already integrated in a communication network or connected to another device, or that it is in a mode of operation in which it actively sends requests for integration in a communication network or for setup of a connection to another electronic device itself and/or reacts to such requests that it receives itself with an appropriate response message. In other words, a node can be formed for example by any Bluetooth- or WLAN-compatible device that is currently actively connected to another device and/or is integrated in a specific WLAN network, or at least is detectable by other devices for the setup of a connection.

In particular, a node in this sense also includes a WLAN router or another device acting as a distribution node of a specific and spatially bounded, wireless communication network and identifiable as such. Possible distribution nodes of this kind are, for example, private WLAN routers, but also local beacons (such as radio beacons). In particular, a node may therefore also be mobile. This applies for example to a network of a motor vehicle (e.g. internal Bluetooth network for connection to the driver's smartphone) or of a rail vehicle (e.g. a router of a WLAN network in a local or long-distance train or the like).

A parameter of the signal processing of the hearing device includes in particular a gain factor for one or more frequency bands, a directional microphone setting, a setting regarding a degree of reverberation rejection, etc. Parameters that are further included are preferably also time constants for a detection of voice and/or rejection of feedback, limit values for a noise background or for a voice component or the like. Automatic setting of the at least one parameter of the signal processing means that a specific value for the respective parameter is stipulated on the described basis, that is to say a value of the gain in the relevant frequency band in the case of a frequency-band-dependent gain factor as parameter, or a directivity index (Dl) in the case of a directional microphone setting as parameter, a value of an angular expansion of a directional lobe for a given signal-to-noise ratio (SNR) or the like.

Characteristic information of a node includes in particular information in reference to an identification of the node as part of its communication function, which is sent by the node e.g. as metadata to a potential or actual communication partner for connection setup and/or retention. As such, for example, the setup of Bluetooth or WLAN connections involves the relevant devices transmitting data about the device type (that is to say whether e.g. a smartphone, a TV set or a tablet PC or the like is involved) and data for uniquely identifying the device (e.g. association with a specific user in the sense of "A.N. Other's laptop" or the like, or else numeric or alphanumeric identifier) to potential or actual communication partners.

The examination of whether a node is present is performed in particular by the hearing device, which is appropriately configured for this purpose by a control unit preferably by means of an antenna device and associated control. Alternatively, or additionally, said examination can also be made by means of an appropriately configured auxiliary apparatus that is configured for communication with the hearing device and that, in particular, can also ascertain the characteristic information of the node. An auxiliary apparatus of this kind includes in particular a cell phone, preferably a smartphone, and an external operating unit provided for the hearing device in a dedicated manner.

The characteristic information of the node detected as present can be used as a basis in particular for checking whether this node is already known for operation of the hearing device, and therefore corresponds to known spatial surroundings. To this end, the characteristic information is compared with corresponding first characteristic information, in particular stored in the hearing device or in an auxiliary apparatus, of nodes defined as known, as a result of which the surroundings can be identified on the basis of the nodes present that are ascertained as known. Such a check with regard to the known nodes can also be performed by the auxiliary apparatus, as a result of which the hearing device just needs to be notified of the accordingly identified surroundings, and these surroundings are used in the hearing device as a basis for effecting the automatic setting of the at least one parameter. Preferably, in this case a value to be set for the at least one parameter of the signal processing is stored for known surroundings, as result from the simultaneous presence of a number of known nodes, as appropriate.

If a node that is present is not determined to be known, or the node(s) detected as known do(es) not correspond to known surroundings for which an associated setting of at least one parameter of the signal processing was stored, surroundings can be detected on the basis of metadata (as characteristic information) that are transmitted by the node. Such metadata can comprise e.g. details of a location and/or the type of the node (in particular with regard to an associated electronic device). In particular in public buildings such as authorities, but also hospitals or the like, for example names are chosen for WLAN networks such that a user can recognize the network as associated with the building. This characteristic information can be used for example to step up the gain over a wide band upon detection of a hospital so as to cause the wearer of the hearing device to speak more softly in a manner appropriate to the surroundings.

According to the invention, the characteristic information for the node detected as present is compared with a first dataset of first characteristic information that was respectively stored beforehand for nodes marked as known, and the comparison results in the node detected as present being detected as a known node or as an unknown node on the basis of the characteristic information. Preferably, if the node detected as present is detected as a known node on the basis of the characteristic information then the at least one parameter of the signal processing of the hearing device is set on the basis of second characteristic information that is dependent on the known node and was stored in a second dataset beforehand on the basis of the known node. In this case the first dataset preferably stores appropriate first characteristic information for all known nodes.

The second characteristic information can firstly directly comprise a value to be set for the at least one parameter of the signal processing and can be directly associated with the relevant node via the first characteristic information, or can concern a group of known nodes that stipulate specific surroundings in which a specific value is to be set for a parameter.

Advantageously, first characteristic information in reference to an identification of the respective node is respectively stored in the first dataset, in particular by means of a user input, for a number of nodes of at least one first wireless communication network that are not yet marked as known, and this marks the respective node as known. In particular, the available characteristic information can be stored as first characteristic information in the first dataset (the first dataset thereby undergoes an update) for a detected node for which there is not yet any first characteristic information stored in the first dataset, and which accordingly is not yet deemed to be known, and as such the node can be marked as "known" for the future. The first characteristic information is preferably assigned a setting for the at least one parameter of the signal processing, as a result of which this setting becomes available for automatic setting when the thus associated node is detected as present in future.

Expediently, a number of known electronic surroundings that respectively exist as a result of the simultaneous presence of a number of specific known nodes are defined, in particular by means of a user input, wherein the second characteristic information defined for at least one of the electronic surroundings is the setting of the parameter of the signal processing of the hearing device, and this setting is stored in the second dataset, wherein an analysis is performed with regard to the presence of one of the known electronic surroundings defined beforehand, and in the case that one of the known electronic surroundings defined beforehand is present then the applicable second characteristic information is used as a basis for setting the parameter of the signal processing of the hearing device. This means in particular that known nodes that can be detected on the basis of applicable first characteristic information are used to define surroundings in which one or more specific known nodes are simultaneously present. The nodes can be used as a basis for identifying these electronic surroundings again at a later time, and for again setting a signal processing parameter value—following appropriate storage and association with the electronic surroundings as second characteristic information (or as part of second characteristic information)—that is used or defined when defining the electronic surroundings.

The definition of the electronic surroundings as the simultaneous presence of specific known nodes—and hence of specific electronic devices or WLAN routers with communication capability—can be provided on the basis of a user input, in particular using an auxiliary apparatus such as a smartphone or the like. The definition of the surroundings can also be provided such that the stipulation of the electronic surroundings now also marks as known such nodes as were not yet marked as "known" before said definition. In this case it is thus in particular not necessary in totally new surroundings to first mark individual nodes and to store applicable first characteristic information before the electronic surroundings can be defined. Rather, the method also allows the nodes involved to be marked as known as a result of the electronic surroundings being stipulated.

It is found to be of further advantage that if the node detected as present is not detected as a known node or is detected as an unknown node on the basis of the characteristic information then an acoustic analysis of the immediate surroundings of the hearing device is performed, in particular by the hearing device. This allows provision for the circumstance that if an unknown node (and hence e.g. a new electronic device or WLAN network or the like for the system) is detected, there are no values stored for settings of the parameters of the signal processing. An acoustic analysis, in particular with regard to the particular parameters to be applied for the signal processing in the unknown surroundings, is therefore advantageous. In this case the at least one parameter of the signal processing of the hearing device is advantageously set on the basis of the acoustic analysis of the immediate surroundings of the hearing device.

Preferably, in particular when an unknown node is present, the characteristic information used for setting the at least one parameter of the signal processing of the hearing device is metadata of the node detected as present that are provided by the node. In particular, logical detection and evaluation of the metadata for the purpose of setting the parameter can be effected in this case, preferably by means of an auxiliary apparatus such as a smartphone. Such metadata can comprise for example information regarding the location and/or the type of an electronic device or network, such as e.g. "Presentation Room Monitor" or the like, and this example could result in it being detected that presentations generally take place in such a room, which means that highly directional sound processing (in the frontal direction, that is to say the assumed line of vision to the monitor) appears appropriate. This is advantageous in particular for unknown nodes but can also be performed for assistive purposes while for example an analysis with regard to whether the node is known is still being performed, or the like.

In this regard the metadata are preferably analyzed for a possible type and/or a possible location of the node by means of a comparison against a database and/or by means of artificial intelligence. In this regard the metadata are preferably analyzed by means of an auxiliary apparatus associable with the hearing device, e.g. a smartphone, and/or are transferred to a cloud server for analysis. The database for the applicable comparison in this case can be stored on the auxiliary apparatus or in the cloud server and can comprise different forms of possible metadata and corresponding information with regard to the type or location of a node. The type of a node is defined in particular by the technical nature of the applicable network and/or electronic device forming the node, whereas a location can be defined in particular by a particular use of a room or building, possibly in combination with geographical information.

Artificial intelligence for analysis—possibly on the basis of a comparison against a database using common types of metadata such as, say, name and/or location information of devices and/or networks—can firstly be provided on a processor of the auxiliary apparatus configured for this purpose as appropriate by means of programming, installation of required apps, etc. Secondly, the auxiliary apparatus can also transfer the metadata to a cloud server, that is to say in particular to a virtual web portal provided and configured for this purpose as appropriate and having allocated memory for metadata to be compared, allocated processor power and associated main memory for performing the analysis by means of artificial intelligence.

Preferably, the presence of an WLAN router and/or a cell phone and/or a computer, in this instance in particular also a laptop or tablet PC, and/or a consumer electronics device such as e.g. a music system or stereo system, a Bluetooth loud-speaker, a television, a video projector or a games console, and/or a smart home device and/or a home communications system, in this instance in particular a baby monitor or a paging system for dependents as a node of a wireless communication network is examined. The cited devices as nodes permit reliable detection of a return to a location for which previous settings for parameters have already been stored, on the basis of the known nodes.

In a more advantageous refinement, the immediate surroundings of the hearing device are examined for the presence of the at least one node of the wireless communication network by means of a check on an existing wireless signal connection and/or on the basis of a request to make a wireless signal connection. Said examination can be made by the hearing device itself, or by an auxiliary apparatus with a signal connection to the hearing device, such as e.g. a smartphone. Most popular electronic devices used in households or in public administration buildings are configured to be able to communicate their presence to other devices if necessary, by means of said requests (either by actively sending requests or by responding to incoming requests). This can be exploited as part of the method for detecting nodes.

The immediate surroundings of the hearing device are advantageously examined with regard to a WLAN signal connection and/or a Bluetooth signal connection. These are the most common types of connection, which means that detection of WLAN and/or Bluetooth connections that are present can be used for reliably identifying surroundings that are already known per se for the signal processing.

A signal strength of a wireless signal connection is advantageously ascertained, wherein the signal strength is used for assessing the presence of the at least one node. In particular, a node that is intended to be identified on the basis of an applicable signal connection can be regarded as "present" if the signal strength of the signal connection exceeds a predefined absolute or relative limit value. This permits noise signals to be ignored, in particular, and hence the node to be identified as present particularly reliably. In particular, this means that e.g. in buildings having a multiplicity of identical electronic devices (e.g. smart monitors in conference rooms of an office building), specific devices can be rejected as possible nodes on account of a weak signal, as a result of which more accurate identification of a specific room in the building also becomes possible.

A sensor signal is preferably generated independently of possible nodes of a wireless communication network, wherein said sensor signal is used for setting the at least one parameter of the signal processing of the hearing device. In this instance generating the sensor signal independently of possible nodes includes in particular a generating sensor not being geared to capturing the nodes, and hence an existing configuration of nodes not influencing the sensor signal—beyond unwanted electromagnetic interference—in particular.

Such a sensor signal can be generated in particular by a sensor of the hearing device or of an auxiliary apparatus connectable to the hearing device, and e.g. can contain position and/or temperature and/or acceleration information. A comparison of the ascertained nodes and in particular of electronic surroundings detected on the basis of said nodes using such a sensor signal permits a particularly reliable identification of the actual acoustophysical surroundings of the hearing device. The sensor signal generated, in particular by means of a GPS sensor, is advantageously a position signal. In particular, setting the at least one parameter of the signal processing involves the position signal being compared against location information obtained on the basis of the nodes detected as present.

It is found to be more advantageous if at least part of the examination of the immediate surroundings of the hearing device for the presence of the at least one node of the wireless communication network is performed by an auxiliary apparatus associable with, that is to say in particular wirelessly connectable to, the hearing device and preferably usable for marking nodes as known and for defining known electronic surroundings. In this case the auxiliary apparatus can in particular also perform an examination of a present node for whether it is known, and can e.g. transmit the applicable characteristic information to the hearing device. It is also conceivable for the auxiliary apparatus to store the parameter values that need to be set for specific nodes and for only the parameters to be transmitted from the auxiliary apparatus to the hearing device when the relevant node is detected as being present. In general, the use of such an auxiliary apparatus permits parts of the method to be performed on same, which allows the battery power of the hearing device to be saved.

The auxiliary apparatus preferably used is a cell phone, in particular a smartphone. In particular, a tablet PC or a dedicated remote-control unit of the hearing device can also be used as auxiliary apparatus.

With the above and other objects in view there is also provided, in accordance with the invention, a system with a hearing device, wherein the system is configured for performing the method described above. The system according to the invention shares the advantages of the method according to the invention. The advantages indicated for the method and for its developments can be transferred mutatis mutandis to the system. The system preferably comprises an auxiliary apparatus for performing at least parts of the method. In particular, the auxiliary apparatus is provided by a cell phone, preferably a smartphone.

Other features which are considered as characteristic for the invention are set forth in the appended claims.

Although the invention is illustrated and described herein as embodied in method for automatically setting a parameter of a signal processing of a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Mutually corresponding parts and variables are identified with the same reference numerals throughout the figures.

DETAILED DESCRIPTION OF THE INVENTION

Figure 1:
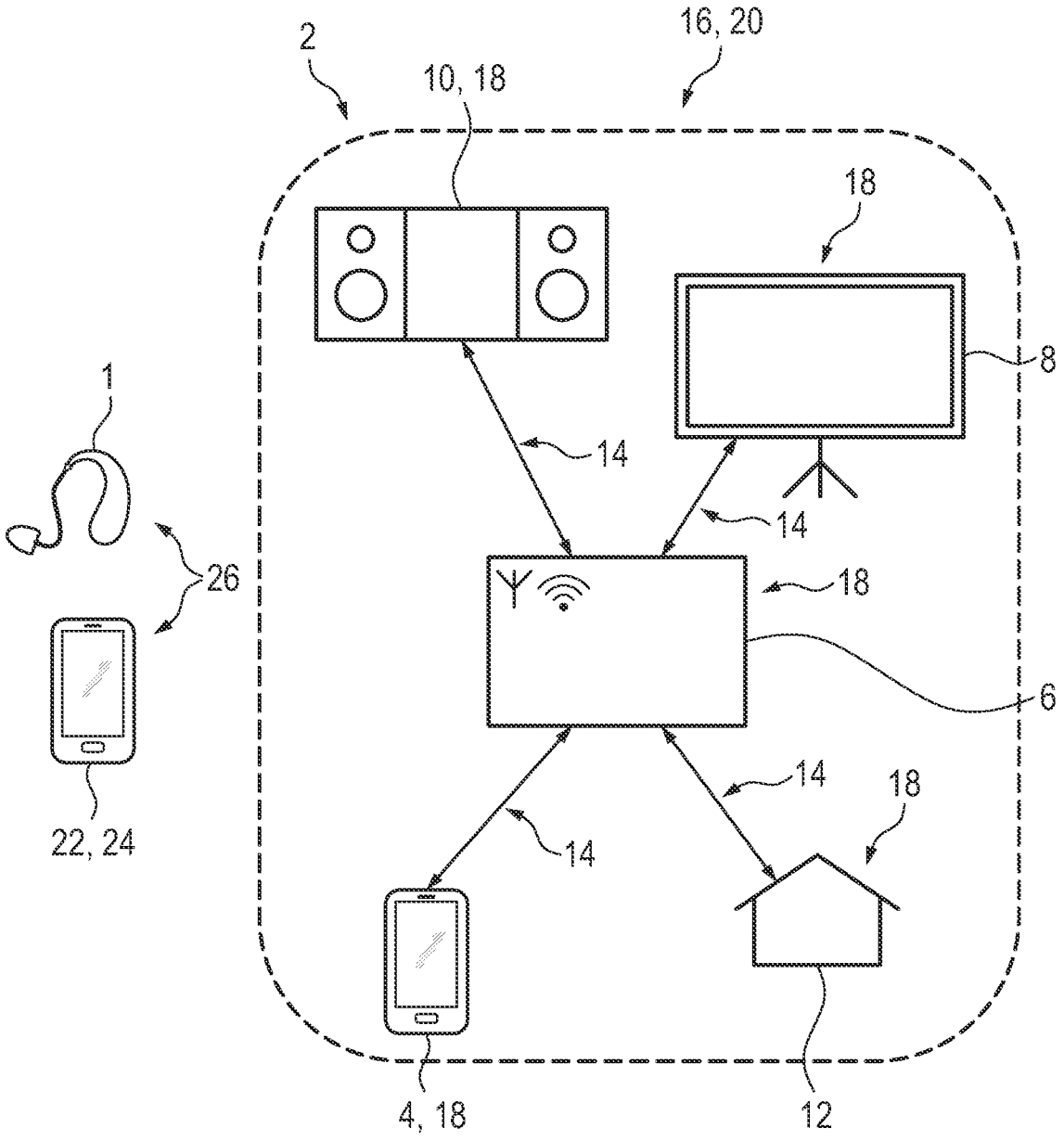
FIG. 1 shows electronic surroundings of a hearing device in a diagram.

Referring now to the figures of the drawing in detail and first, in particular, to FIG. 1 thereof, there is shown a schematic depiction of a hearing device 1 situated in surroundings 2. The surroundings 2 of the hearing device 1 comprise a smartphone 4, a WLAN router 6, a television 8 in the form of a smart TV, a multimedia channel stereo system 10, and possibly also elements of a smart home system 12, which will not be specified further at this juncture. Each of the smartphone 4, the television 8, the stereo system 10, and the smart home system 12 has a signal connection 14 to the WLAN router 6, which means that this forms a wireless communication network 16, the subscribers just mentioned (including the WLAN router 6) forming individual nodes 18 in this communication network 16. The hearing device 1 now examines the surroundings 2, preferably using an antenna apparatus that is suitable for this purpose, for the presence of the nodes 18 of the wireless communication network 16, for example by checking that the signal connections 14 are present. In the example depicted in FIG. 1 the individual subscribers of the communication network 16, that is to say the smartphone 4, the television 8, the stereo system 10, the smart home system 12 and also the WLAN router 6, are detected as nodes 18 of the communication network 16 that are present.

An examination of whether the subscribers, i.e., the nodes 18, are known to the hearing device 1 is now made, preferably on the basis of identification information transmitted at the same time as data packets are sent using the respective data transmission protocol for the signal connections 14 between the individual subscribers of the communication network 16. If this is the case for all of the nodes 18 that are present, the nodes form electronic surroundings 20 for the hearing device 1, these being used as a basis for the hearing device to be able to detect the current spatial whereabouts of its user and in particular also his presence in a specific space, room or the like. One or more parameters of the hearing-device-internal signal processing can now be adapted in the hearing device 1 for the present, known electronic surroundings 20 in accordance with a definition provided for the electronic surroundings 20 beforehand. As a result, there is no need for a detailed acoustic analysis of the surroundings 2 for the purpose of adapting the hearing device settings, since these can simply be taken from a memory, assuming that when the settings for the parameters of the signal processing are created and accordingly stored they continue to retain their validity for the user of the hearing device 1 at the same location (detected by the electronic surroundings 20), since in particular the physical structure of the space ought not to have changed, and also other acoustic circumstances (e.g. use as a conference room, living room with only a few people present, which can be detected by each of their smartphones, etc.) have not changed according to the assumption.

The examination of the surroundings 2 of the hearing device 1, that is to say in particular with regard to the presence of the nodes 18 of the communication network 16, and/or the analysis of whether the nodes 18 detected as present are known or correspond to known electronic surroundings 20 can in particular also be performed on a smartphone 22 of the user of the hearing device 1. In this case the hearing device 1 and the smartphone 22 as an auxiliary apparatus 24 form a system 26 for operating the hearing device 1. If detection of the nodes 18 present is performed not by the smartphone 22 of the user of the hearing device 1 but rather by the hearing device 1 itself then the smartphone 22 of the user of the hearing device 1 should preferably not be considered as well when ascertaining the electronic surroundings 20, in order to avoid potential distortion of the results, and moreover to be able to save processing power during the analysis.

In an alternative embodiment, the subscribers of the communication network 16 that are respectively connected to the WLAN router 6 (i.e., the smartphone 4, the television 8, the stereo system 10, and the smart home system 12) can also transfer information for their identification to the WLAN router 6, so that said information can be retrieved via the WLAN router 6 for the hearing device 1 for the purpose of identifying the electronic surroundings 20. The information can then be transferred from the WLAN router 6 to the hearing device 1, which can have an analysis performed on the smartphone 22 of the user of the hearing device 1 on a case-by-case basis (following appropriate prior transfer of the data, or part thereof, received from the WLAN router 6), or said data can be transferred from the WLAN router 6 directly to the smartphone 22 of the user of the hearing device 1, and analyzed there completely. Information with regard to the electronic surroundings 20 is preferably output to the hearing device 1 in this case, said information being used in the hearing device 1 as a basis for selecting an appropriately stored setting of the parameters of the signal processing. Such a setting for the parameters of the signal processing can also be stored on a memory of the smartphone 22, however, and transferred directly to the hearing device 1 in accordance with the ascertained electronic surroundings 20 for application.

Figure 2:
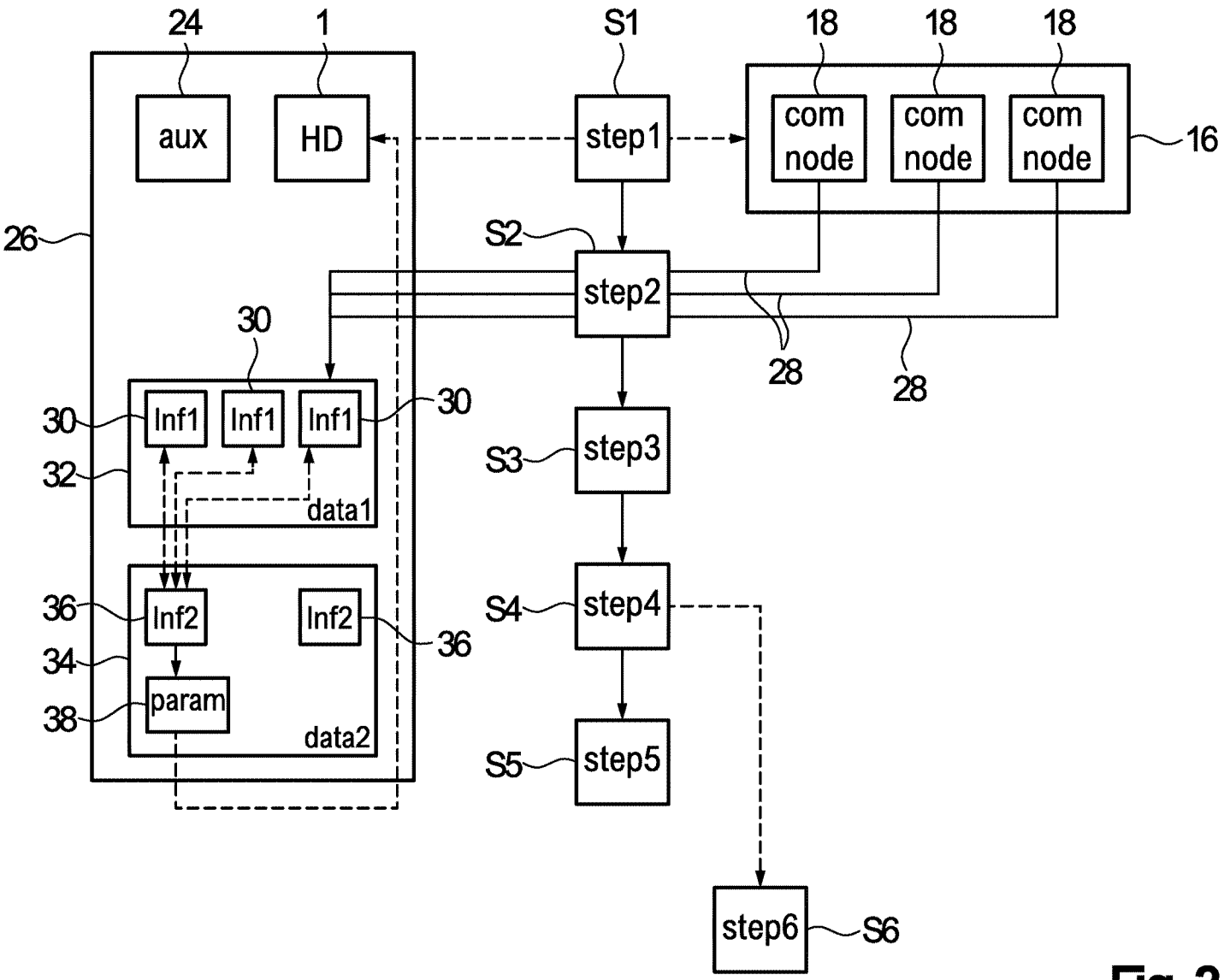
FIG. 2 is a block diagram illustrating a method according to the invention for automatically setting parameters of the signal processing for the hearing device shown in FIG. 1 in dependence on the electronic surroundings.

FIG. 2 once more schematically shows the system of the method just presented on the basis of FIG. 1 for automatically setting a parameter of the signal processing of the hearing device 1 in a block diagram. The system 26 comprises the hearing device 1 and an auxiliary apparatus 24 associable with the hearing device 1, that is to say for example the smartphone 22 shown in FIG. 1, which can be connected to the hearing device 1 via Bluetooth or a similar protocol. In a first step S1 the system 26 now checks whether nodes 18 of a wireless communication network 16 are present in the immediate surroundings. If this is the case, the system 26 fetches respective characteristic information 28 for each of the nodes 18 present in a step S2, said characteristic information being used by the system 26 as a basis for attempting to identify the nodes 18. Said identification is effected in a step S3 by comparing the respective characteristic information 28 of the nodes 18 present with first characteristic information 30 stored in the system in a first dataset 32. The first dataset can be stored on a memory of the hearing device 1 or a memory of the auxiliary apparatus 24. If all of the nodes 18 present are thus identified as known, a check is performed in a step S4 to determine whether a previous setting for one or more parameters of the signal processing of the hearing device 1 is stored in the system 26 for this combination of known nodes. This is preferably achieved by virtue of a second dataset 34 of the system storing a plurality of second items of characteristic information 36 that each define individual electronic surroundings like the electronic surroundings 20 shown in FIG. 1 on the basis of simultaneously present nodes 18 by means of the respective first characteristic information 30 and assign each electronic surroundings 20 a parameter set 38 that needs to be applied in the signal processing of the hearing device 1 in the event of the nodes 18 detected as present being concordant, and is applied accordingly in a step S5.

However, if no such parameter set 38 is stored in the system 26 for the nodes 18 detected as present and possibly as known, an acoustic analysis of the surroundings 2 is preferably effected in order to generate a corresponding new parameter set 38 (step S6). In addition, metadata of the characteristic information 28 can also be used (in particular metadata concerning a location of the respective node 18). The parameter set that was thus ascertained in step S6 on the basis of the acoustic analysis can now be applied in the hearing device 1, and additionally also modified for the needs of the user of the hearing device 1 by user inputs, preferably by means of the auxiliary apparatus 24.

An applicable user input allows characteristic information 28 not yet stored in the first dataset 32 to be stored as first characteristic information 30, and the whole present electronic surroundings 20 to be stored in the second dataset 34 as second characteristic information 36 by all the nodes 18 present (by means of the first characteristic information 30 that is now stored in the first dataset 32). The parameter set 38 that needs to be applied in the present case is also stored. As a result, all nodes are now marked as known, and the present surroundings 2 are defined as electronic surroundings 20.

Although the invention has been illustrated and described more thoroughly in detail by the preferred exemplary embodiment, the invention is not limited by this exemplary embodiment. Other variations can be derived therefrom by a person skilled in the art without departing from the scope of protection of the invention.

The following is a summary list of reference numerals and the corresponding structure used in the above description of the invention:

1 hearing device
2 surroundings
4 smartphone
6 WLAN router
8 television (smart TV)
10 stereo system
12 smart home system
14 signal connection
16 communication network
18 node
20 electronic surroundings
22 smartphone
24 auxiliary apparatus
26 system
28 characteristic information
30 first characteristic information
32 first dataset
34 second dataset
36 second characteristic information
38 parameter set
S1-S6 method steps

The invention claimed is:

1. A method of automatically setting at least one parameter for signal processing in a hearing device, the method comprising:

examining immediate surroundings of the hearing device for a presence of at least one node of a wireless communication network, wherein a node that is detected as being present is a detected node;

ascertaining characteristic information of the detected node;

comparing the characteristic information of the detected node with a first dataset of first characteristic information respectively stored beforehand for nodes that are marked as known, and concluding whether the detected node is a known node or an unknown node;

using the characteristic information of the detected node as a basis for setting the at least one parameter for the signal processing of the hearing device;

if the node detected as present is determined to be a known node based on the characteristic information then the at least one parameter of the signal processing of the hearing device is set on the basis of second characteristic information that is dependent on the known node and was stored in a second dataset beforehand on the basis of the known node;

defining a plurality of known electronic surroundings that respectively exist as a result of a simultaneous presence of a number of specific known nodes;

using the second characteristic information defined for at least one of the electronic surroundings as the setting of the parameter of the signal processing of the hearing device, and storing the setting in the second dataset;

performing an analysis with regard to a presence of one of the known electronic surroundings defined beforehand; and if one of the known electronic surroundings defined beforehand is present, using the applicable second characteristic information as a basis for setting the parameter for the signal processing of the hearing device.

2. The method according to claim 1, which comprises storing first characteristic information in reference to an identification of the respective node in the first dataset for a number of nodes of at least one first wireless communication network that are not yet marked as known, and thereby marking the respective node as a known node.

3. The method according to claim 1, which comprises, if the detected node is not determined to be a known node based on the characteristic information, performing an acoustic analysis of the immediate surroundings of the hearing device.

4. The method according to claim 3, which comprises setting the at least one parameter of the signal processing of the hearing device on a basis of the acoustic analysis of the immediate surroundings of the hearing device.

5. The method according to claim 1, which comprises performing at least a portion of the step of examining the immediate surroundings of the hearing device for the presence of the at least one node of the wireless communication network by an auxiliary apparatus associable with the hearing device.

6. The method according to claim 5, wherein the auxiliary apparatus used is a cell phone.

7. The method according to claim 1, wherein the examining step comprises searching for a node of a wireless communication network, the node being selected from the group consisting of a WLAN router, a cell phone, a computer, a consumer electronics device, a smart home device, and a home communications system.

8. The method according to claim 7, wherein the examining step comprises examining the immediate surroundings of the hearing device by checking an existing wireless signal connection and/or issuing a request to make a wireless signal connection.

9. The method according to claim 8, which comprises examining the immediate surroundings for a WLAN signal connection and/or a Bluetooth signal connection.

10. The method according to claim 7, which comprises ascertaining a signal strength of a wireless signal connection and using the signal strength for assessing the presence of the at least one node.

11. The method according to claim 1, which comprises:

generating a sensor signal independently of possible nodes of a wireless communication network; and using the sensor signal for setting the at least one parameter of the signal processing of the hearing device.

12. The method according to claim 11, wherein the step of generating the sensor signal comprises generating a position signal.

13. A system having a hearing device, wherein the system is configured for performing the method according to claim 1.

14. The system according to claim 13, further comprising an auxiliary apparatus associable with the hearing device and configured for examining the immediate surroundings of the hearing device for the presence of the at least one node of the wireless communication network.

15. The system according to claim 14, wherein said auxiliary apparatus is a smart phone configured for communication with the hearing device.

16. A method of automatically setting at least one parameter for signal processing in a hearing device, the method comprising:

examining immediate surroundings of the hearing device for a presence of at least one node of a wireless communication network, wherein a node that is detected as being present is a detected node;

ascertaining characteristic information of the detected node;

comparing the characteristic information of the detected node with a first dataset of first characteristic information respectively stored beforehand for nodes that are marked as known, and concluding whether the detected node is a known node or an unknown node; and using the characteristic information of the detected node as a basis for setting the at least one parameter for the signal processing of the hearing device, wherein the characteristic information used for setting the at least one parameter of the signal processing of the hearing device is metadata of the detected node that are provided by the node.

17. The method according to claim 16, which comprises analyzing the metadata for a possible type and/or a possible location of the node by way of a comparison against a database and/or by artificial intelligence.

18. The method according to claim 16, which comprises performing at least a portion of the step of examining the immediate surroundings of the hearing device with an auxiliary apparatus associable with the hearing device, and analyzing the metadata with the auxiliary apparatus or transferring the metadata to a cloud server for analysis.

* * * * *